US006585543B2

(12) United States Patent
Kuroda et al.

(10) Patent No.: US 6,585,543 B2
(45) Date of Patent: Jul. 1, 2003

(54) ELECTRICAL CONNECTOR

(75) Inventors: Keiji Kuroda, Amagasaki (JP); Kiyoshi Aramoto, Higashi-Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/827,149

(22) Filed: Apr. 5, 2001

(65) Prior Publication Data

US 2001/0029132 A1 Oct. 11, 2001

(30) Foreign Application Priority Data

Apr. 7, 2000 (JP) ..... 2000-111852

(51) Int. Cl.[7] ..... H01R 13/436
(52) U.S. Cl. ..... 439/752
(58) Field of Search ..... 439/752, 595

(56) References Cited

U.S. PATENT DOCUMENTS 6,071,153 A * 6/2000 Fink et al. ..... 439/752
6,149,462 A * 11/2000 Sugie ..... 439/752

FOREIGN PATENT DOCUMENTS

| | | |
|---|---|---|
| EP | 0 755 097 A1 | 1/1997 |
| JP | 9-102348 | 4/1997 |

* cited by examiner

*Primary Examiner*—Gary Paumen
(74) *Attorney, Agent, or Firm*—Rosenthal & Osha L.L.P.

(57) ABSTRACT

An electrical connector of the present invention includes a contact having a first retaining portion; and a housing having an accommodating cavity for accommodating the contact and a second retaining portion that confronts the first retaining portion in such a manner as to prevent the contact from moving in a direction for the contact to be taken out from the cavity when the contact is in the state of being accommodated in the cavity. The housing comprising a first member arranged at a side from which the contact is inserted in the cavity and provided with the second retaining portion; and a second member assembled to the first member so that the second retaining portion can be covered by the second member.

6 Claims, 12 Drawing Sheets

ELECTRICAL CONNECTOR

BACKGROUND OF THE INVENTION

The present invention relates to an electrical connector in which contacts are accommodated in accommodating cavities provided in the housing.

Japanese Laid-open (unexamined) Patent Publication No. Hei 9(1997)-102,348 discloses an electrical connector having female-molded contacts (socket contacts) molded of thin metal sheets and an integrally molded housing having accommodating cavities for the socket contacts. Each socket contact is provided, on its surfaces, with a retaining portion projected out therefrom, and the housing is provided with a retaining portion, which is called a lance, extending toward the inside of the cavity. The two retaining portions do not form any obstacle when the socket contact is in the middle of being accommodated in the cavity. However, when the socket contact comes to a predetermined position in the cavity, the retaining portions are put into positions where they confront each other with respect to the direction for them to be removed from the cavity. Thus, once the socket contact is accommodated in the cavity, it comes to be difficult to take out the socket from the cavity.

In recent years, a low-profile and small-size electrical connector for use in small size electrical equipment or small size electrical equipment, such as personal digital assistants, is being increasingly demanded. When the housing of the electrical connector described in the publication cited above is integrally molded of resin by the molding process, such as injection molding, there is a difficulty in reducing the thickness of the housing further, because the housing must have, at the retaining portions, minimum thickness required to ensure the prevention against the take-out of the socket contacts and also must have enough space for drawing a mold. One conceivable approach for designing a low-profile of the housing is that there are provided openings in the housing at places near the retaining portions projected toward the inside of the cavities, whereby the housing and thus the electrical connector are designed in a low profile, while ensuring the minimum thickness of the retaining portions required for the prevention against the take-out of the socket contact and mold drawing space.

However, when the openings are provided in the housing, the retaining portions of the socket contacts and their surroundings are put in the state of being exposed out through the openings. As a result, there are possibilities that accidental shorting of adjacent socket contacts may be caused by dusts and the like entering from the openings and that an operator may accidentally contact with the socket contact when a pin contact is plugged in or detached from the socket contact inserted in the housing.

SUMMARY OF THE INVENTION

It is an object of the present invention to provide an electrical connector that can be designed in a low profile, while ensuring the minimum thickness of the retaining portions of the housing required for the prevention against the take-out of the contact and mold drawing space, without providing any opening to expose the contacts in the housing.

An electrical connector of the present invention comprises a contact having a first retaining portion; and a housing having an accommodating cavity for accommodating the contact and a second retaining portion that confronts the first retaining portion in such a manner as to prevent the contact from moving in a direction for the contact to be taken out from the cavity when the contact is in the state of being accommodated in the cavity. The housing comprises a first member arranged at a side from which the contact is inserted in the cavity and provided with the second retaining portion; and a second member assembled to the first member so that the second retaining portion can be covered by the second member.

In the present invention, the first retaining portion may be a projection provided on a surface of the contact, and the second retaining portion may be a projection which is shifted to a position where the contact is allowed to move in a direction of being accommodated in the cavity by being pressed by the first retaining portion when the contact is on the way to being accommodated in the cavity and is resiliently returned to a position where the contact confronts the first retaining portion with respect to a direction of being taken out from the cavity when the contact reaches a predetermined position in the cavity.

In the present invention, a portion of the cavity of the second member corresponding to the portion to cover the second retaining portion is preferably larger in thickness than a portion of the same corresponding to the remaining portion.

The electrical connector of the present invention may have a single cavity and a single contact or it may have two or more accommodating cavities and two or more contacts, if needed. Any type of contacts, such as a socket contact and a pin contact, may be used as the contact accommodated in the cavity. The first retaining portion provided on the contact side may be constructed by a recessed portion or a hole formed in the contact, in addition to the projection extending out from the surface of the contact. The housing may be constructed by three or more members including an additional member, without limiting to the first and second members. Further, the first and second member may be fixedly coupled to each other by use of another member or adhesive or may alternatively be detachably assembled to each other by engaging.

Other and further objects, features and advantages of the invention will appear more fully from the following description taken in connection with the accompanying drawings.

DESCRIPTION OF THE PREFERRED EMBODIMENTS

In the following, the electrical connector according to the preferred embodiments of the present invention will be described with reference to the accompanying drawings.

Figure 1:
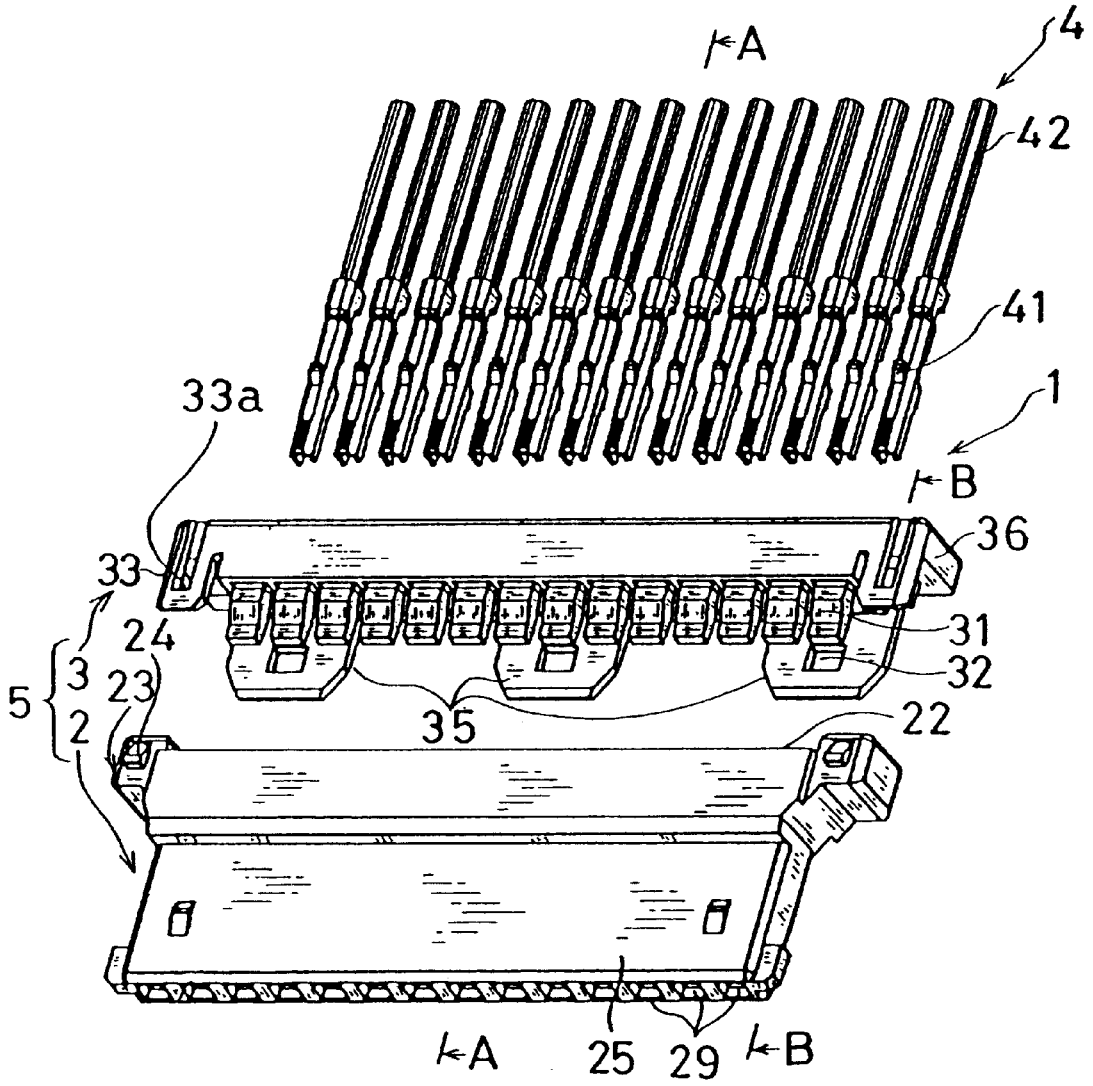
FIG. 1 is a perspective view of an electrical connector before assembling according to a first embodiment of the present invention.
Figure 2:
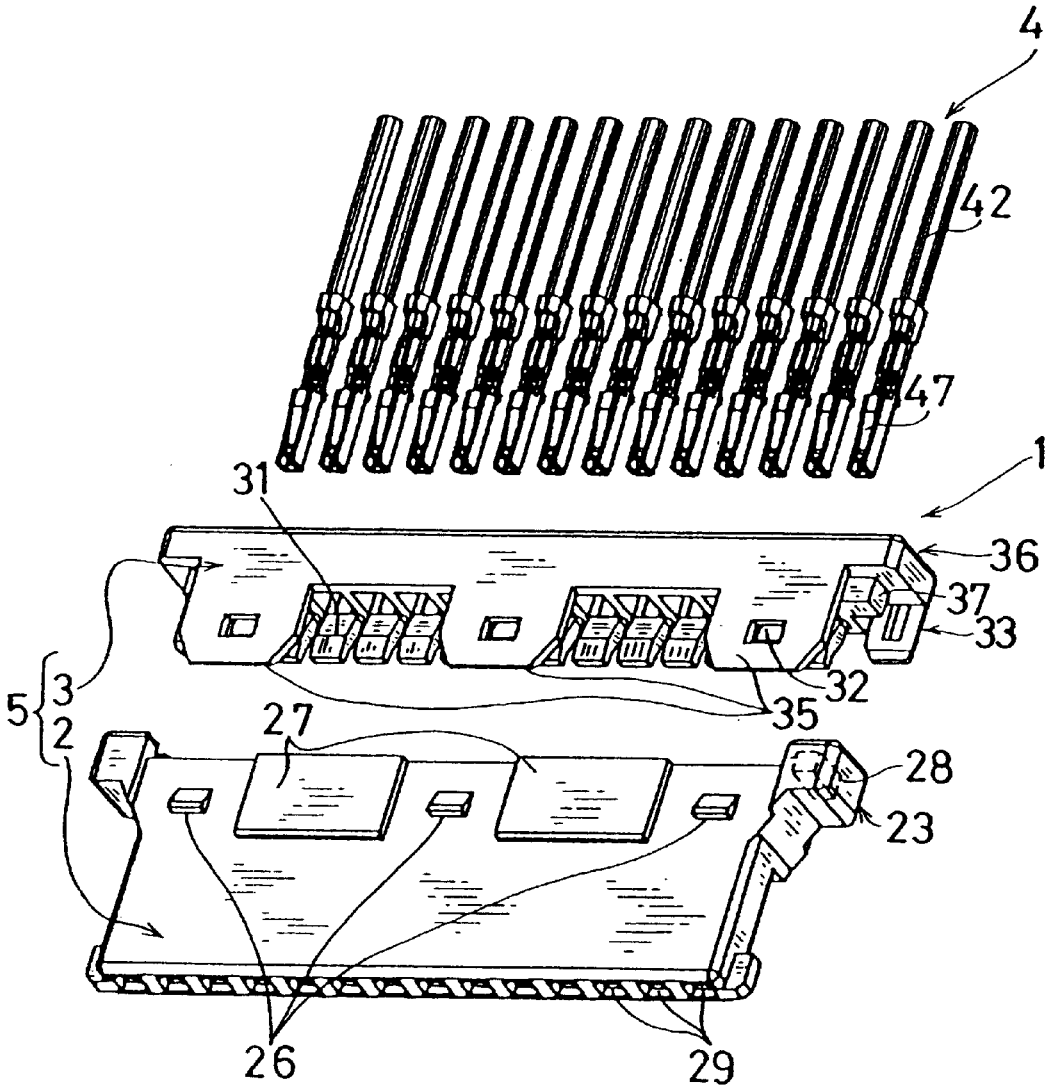
FIG. 2 is a perspective view of the electrical connector according to the first embodiment of the present invention as viewed from the opposite direction to that of FIG. 1.
Figure 7:
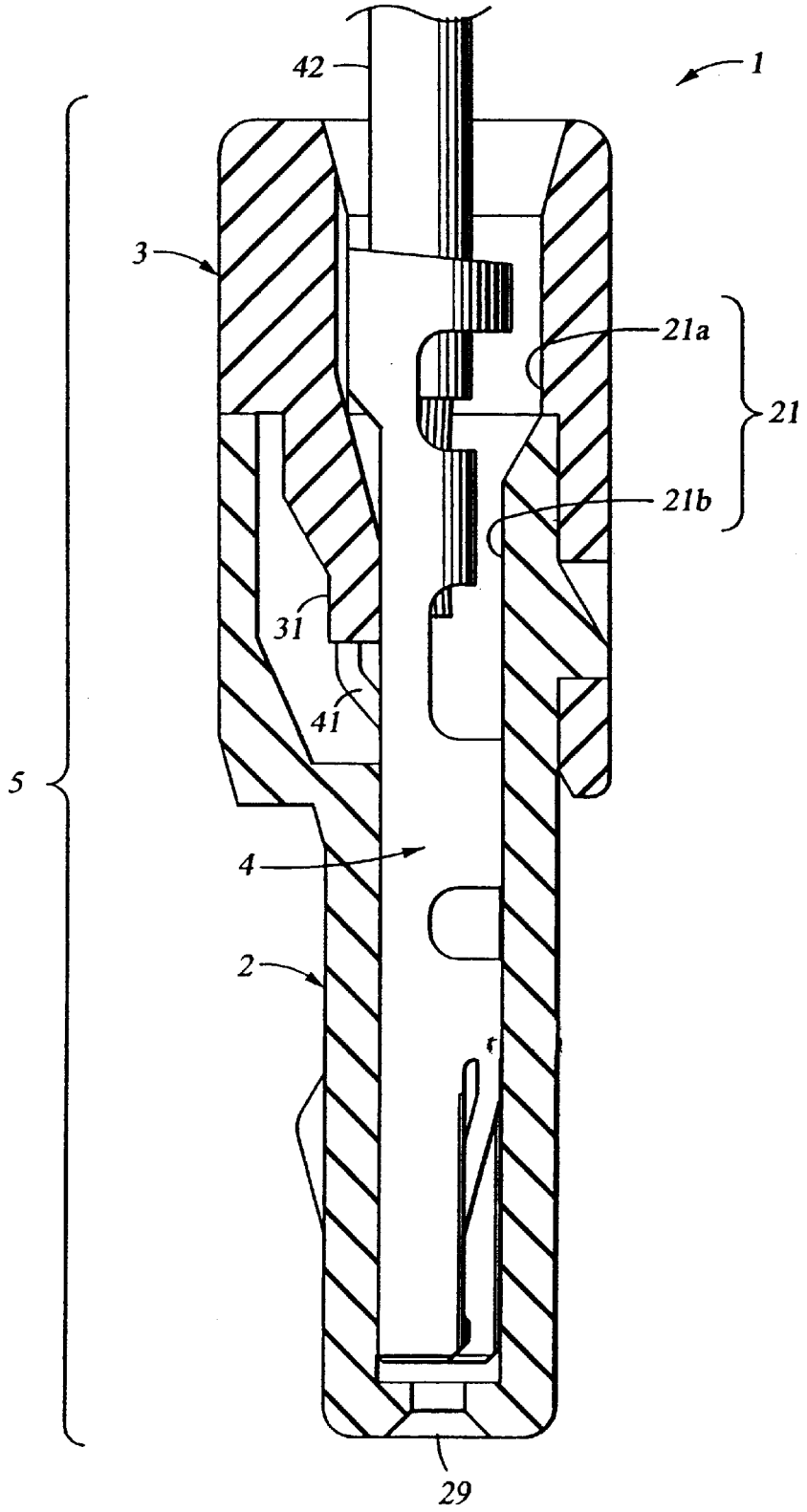
FIG. 7 is a sectional view, taken along line A—A of FIG. 1, showing the assembled state of the electrical connector shown in FIG. 1.

First, the description will be given on the first embodiment of the present invention. As shown in FIGS. 1, 2 and 7, the electrical connector 1 according to the present embodiment comprises (i) a housing 5 formed by combination of a lance housing (first member) 3 and a socket housing (second member) 2 and (ii) fourteen socket contacts 4 accommodated in their respective fourteen accommodating cavities 21, each extending along a nearly whole length of the housing 5. The lance housing 3 and socket housing 2 forming the housing 5 are each integrally molded of appropriate plastic material by injection molding. The each socket contact 4 is formed by bending an appropriate conductive metal sheet. Lead lines 42 are connected to their respective socket contacts 4, as depicted in the drawings.

Figure 3:
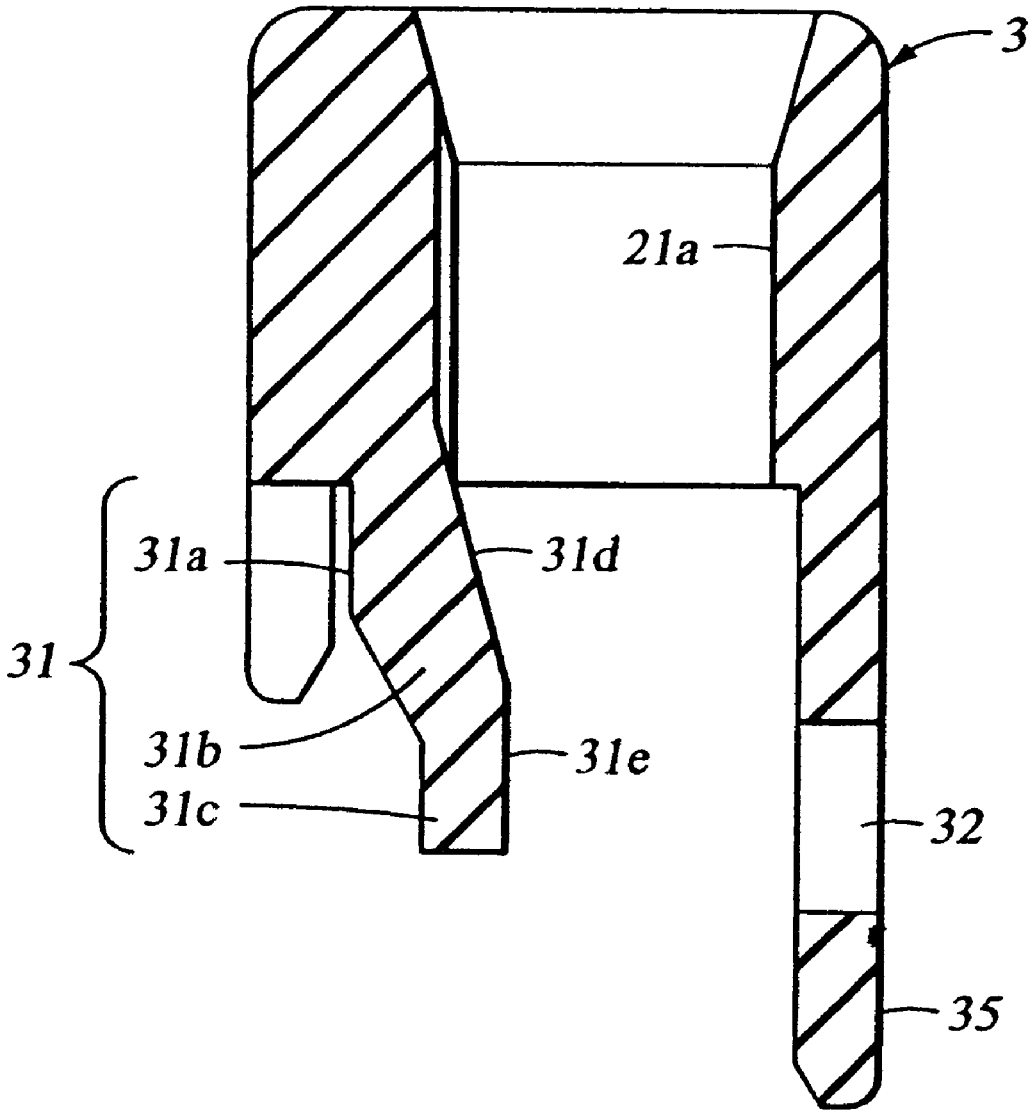
FIG. 3 is a sectional view, taken along line A—A of FIG. 1. of a first member included in the electrical connector shown in FIG. 1.

As shown in FIG. 3, the each cavity 21 has a rear portion 21*a* which is formed in the interior of the lance housing 3 so as to extend through it longitudinally. The each socket contact 4 is inserted into the cavity 21 from an opening at an end of the rear portion 21*a*.

The lance housing 3 has fourteen projections (second retaining portions) 31, each projection called "lance". Each projection 31 is projected from a base portion of the lance housing 3 toward the socket housing 2, and the tip end of the projection 31 is positioned inwardly from the surface of the lance housing 3. When force acting in a direction orthogonal to the projecting direction of the lance housing 3 is exerted on the lance housing 3, the lance housing 3 is resiliently deformed in the same direction as the acting direction of the force. When the force is released, the lance housing 3 is resiliently restored to its original position. In the illustrated embodiment, the fourteen projections 31 are provided for the fourteen socket contacts 4, respectively. Each socket contact 4 can be inserted in the cavity 21 by a slight force only required to resiliently deform the projection 31.

Figure 8:
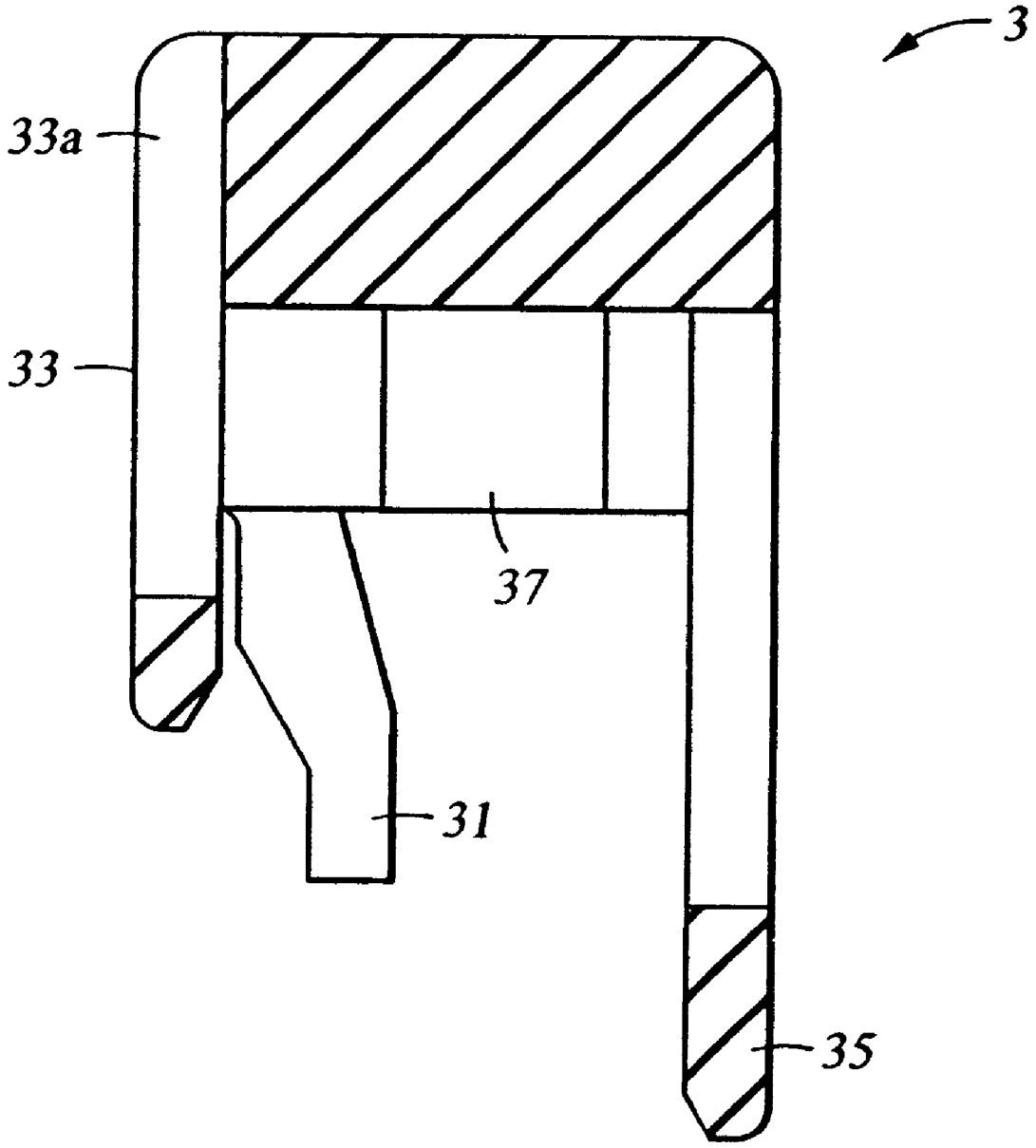
FIG. 8 is a sectional view, taken along line B—B of FIG. 1, of the first member included in the electrical connector shown in FIG. 1.
Figure 9:
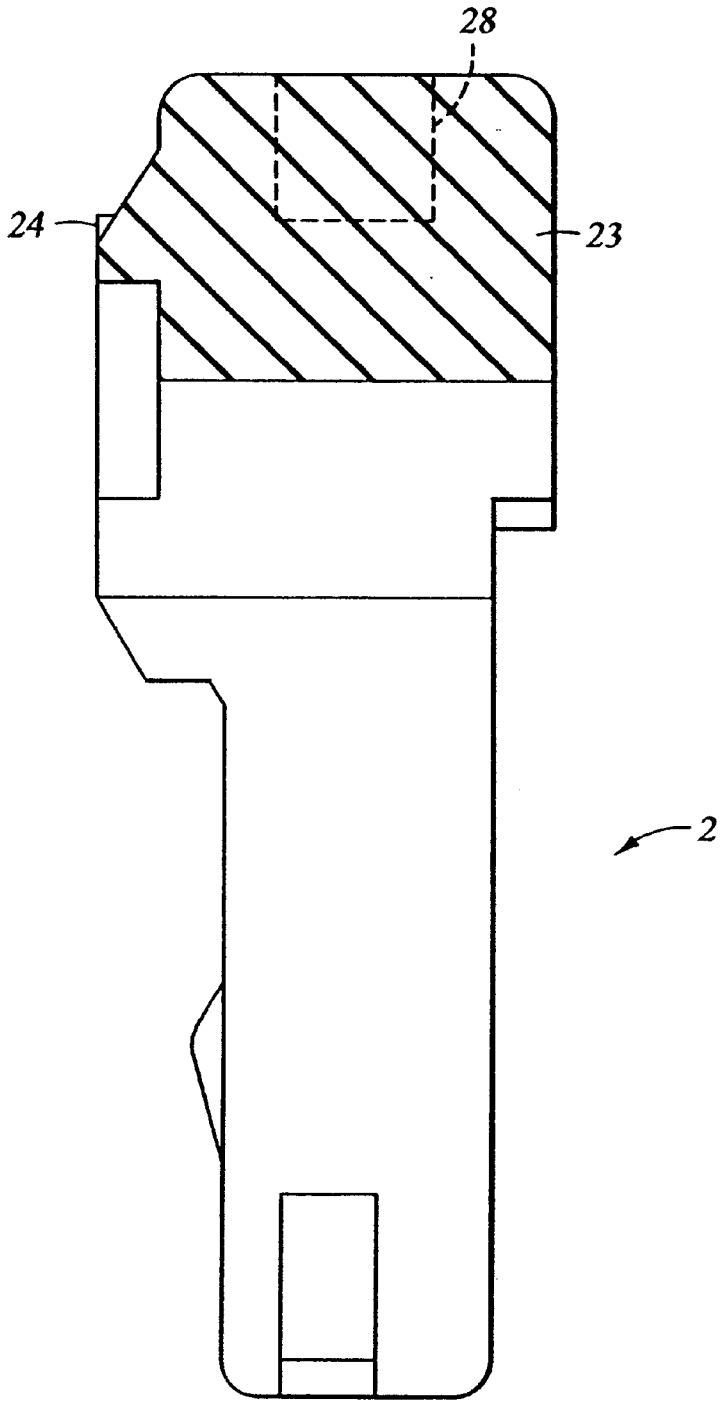
FIG. 9 is a sectional view, taken along line B—B of FIG. 1, of the second member included in the electrical connector shown in FIG. 1.
Figure 10:
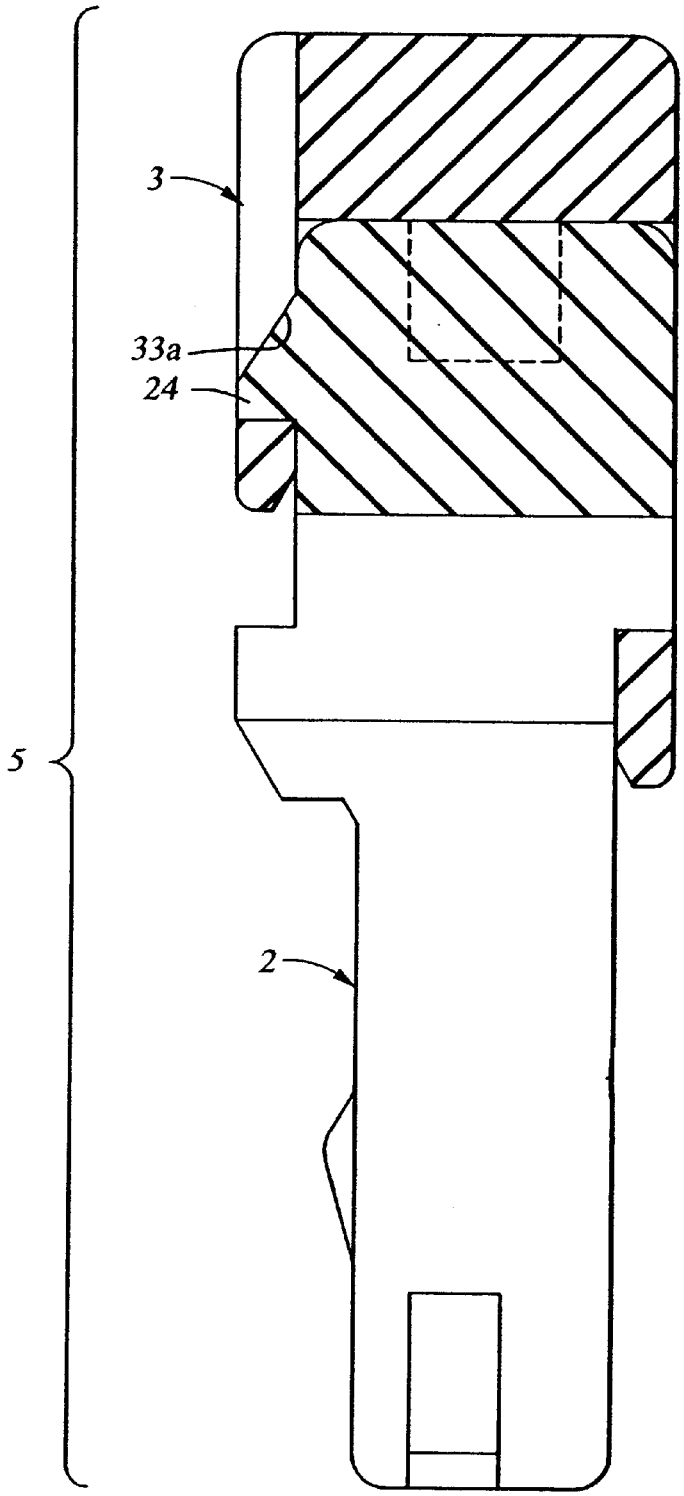
FIG. 10 is a sectional view, taken along line B—B of FIG. 1, showing the assembled state of the first and second members included in a delayed connector shown in FIG. 1.

As shown in FIGS. 1 and 2, the lance housing 3 has three projecting plates 35 each having a generally square form, in addition to the projections 31 and the rear portions 21*a*. The three projecting plates 35 are spaced apart from each other along the longitudinal direction of the lance housing 3 and are arrayed in parallel to the fourteen projections 31. Cutouts of a generally square form are defined between the adjacent projecting plates 35. Each projecting plate 35 has a square hole 32 formed in the center portion of the projecting plate 35. Further, the lance housing 3 has, at both longitudinal ends thereof, side portions 36, at which convex portions 37 projected in a longitudinal direction of the lance housing 3 and projecting plates 33 with slots 33*a* extended in an inserting direction of the socket contact 4, as shown in FIG. 8.

Figure 4:
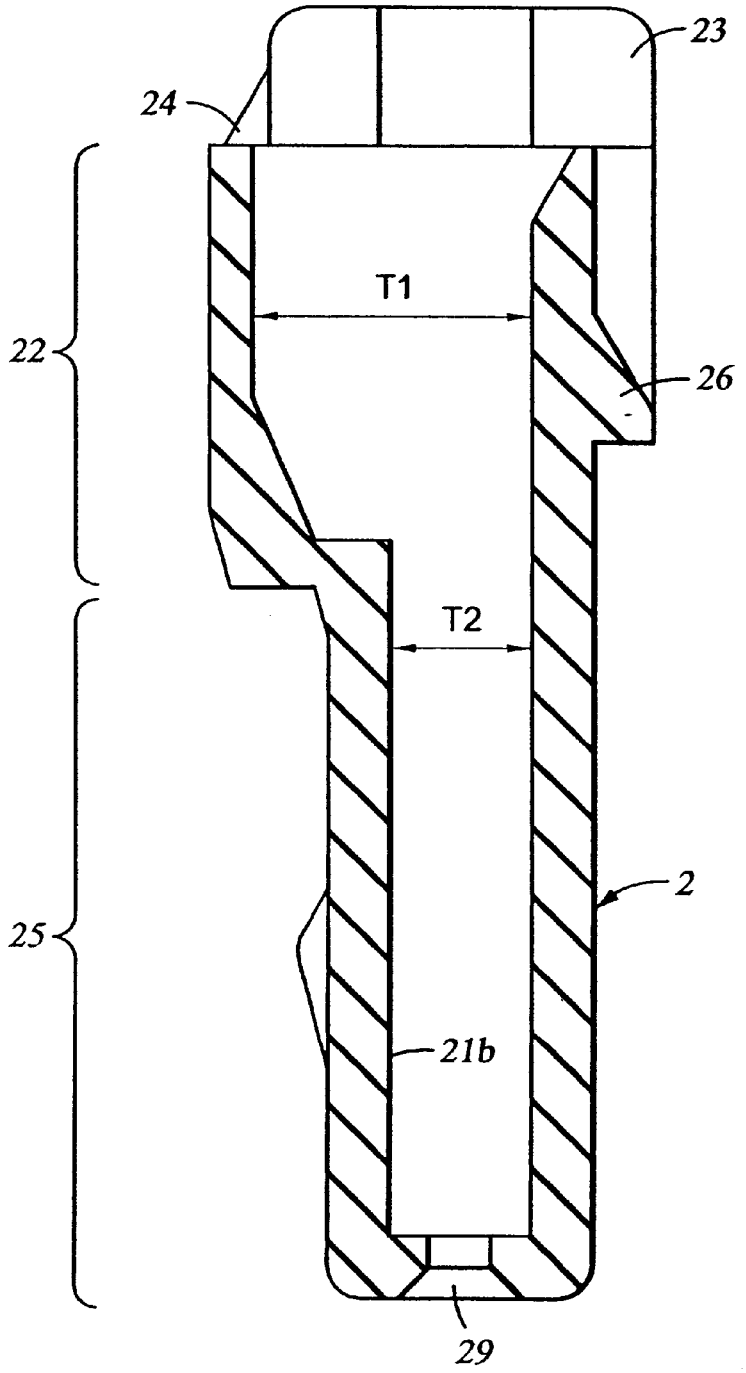
FIG. 4 is a sectional view, taken along line A—A of FIG. 1, of a second member included in the electrical connector shown in FIG. 1.

On the other hand, as shown in FIG. 4, the socket housing 2 has a front portion 21*b* as a part of the cavity 21 which is formed in the interior of the socket housing 2 so as to extend along the longitudinal direction thereof. The front portion 21*b* communicates with outside through an insertion hole 29 of a pin contact (not shown) formed at the end opposite to the lance housing 3.

The socket housing 2 has a length nearly same to the lance housing. Side portions 23, which are located at the both longitudinal ends of the socket housing 2 and at each side of which a projection 24 and a notch 28 are provided, correspond in position to the side portions 36 of the lance housing 3. As shown in FIG. 2, the socket housing 2 has three projections 26 and two protrusions 27 which are alternately formed on one surface of the socket housing 2. The protrusions 27 have a plan configuration substantially corresponding in shape to the generally square formed cutouts defined between two adjacent projecting plates 35 on the lance housing 3.

As shown in FIG. 4, the front portion 21*b* of the cavity 21 of the socket housing 2 has a first region (indicated by reference numeral 22 in FIG. 4) having thickness T1 on the lance housing 3 side, and a second region (indicated by reference numeral 25 in FIG. 4) having thickness T2 on the opposite side. The thickness T1 of the first region is made larger than the thickness T2 of the second region, so as to allow the projection 31 of the lance housing 3 to be easily accommodated in and covered by the first region 22 of the socket housing 2, as mentioned later.

Figure 5:
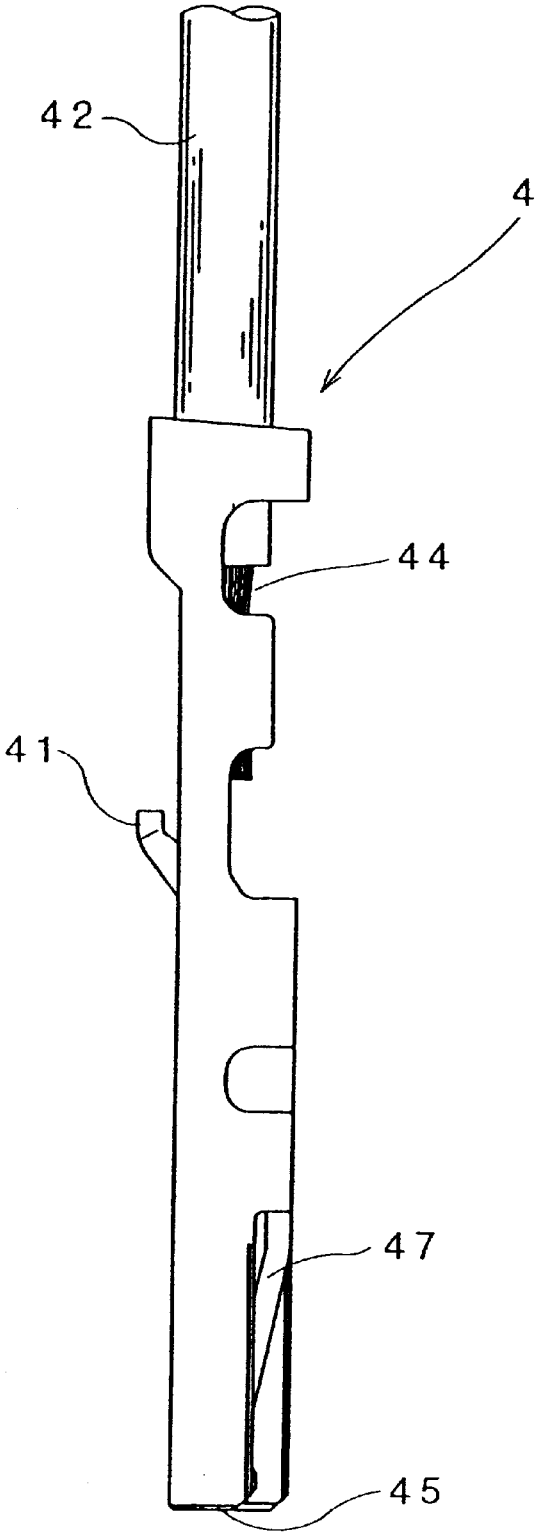
FIG. 5 is a side view of the contact included in the electrical connector shown in FIG. 1.
Figure 6:
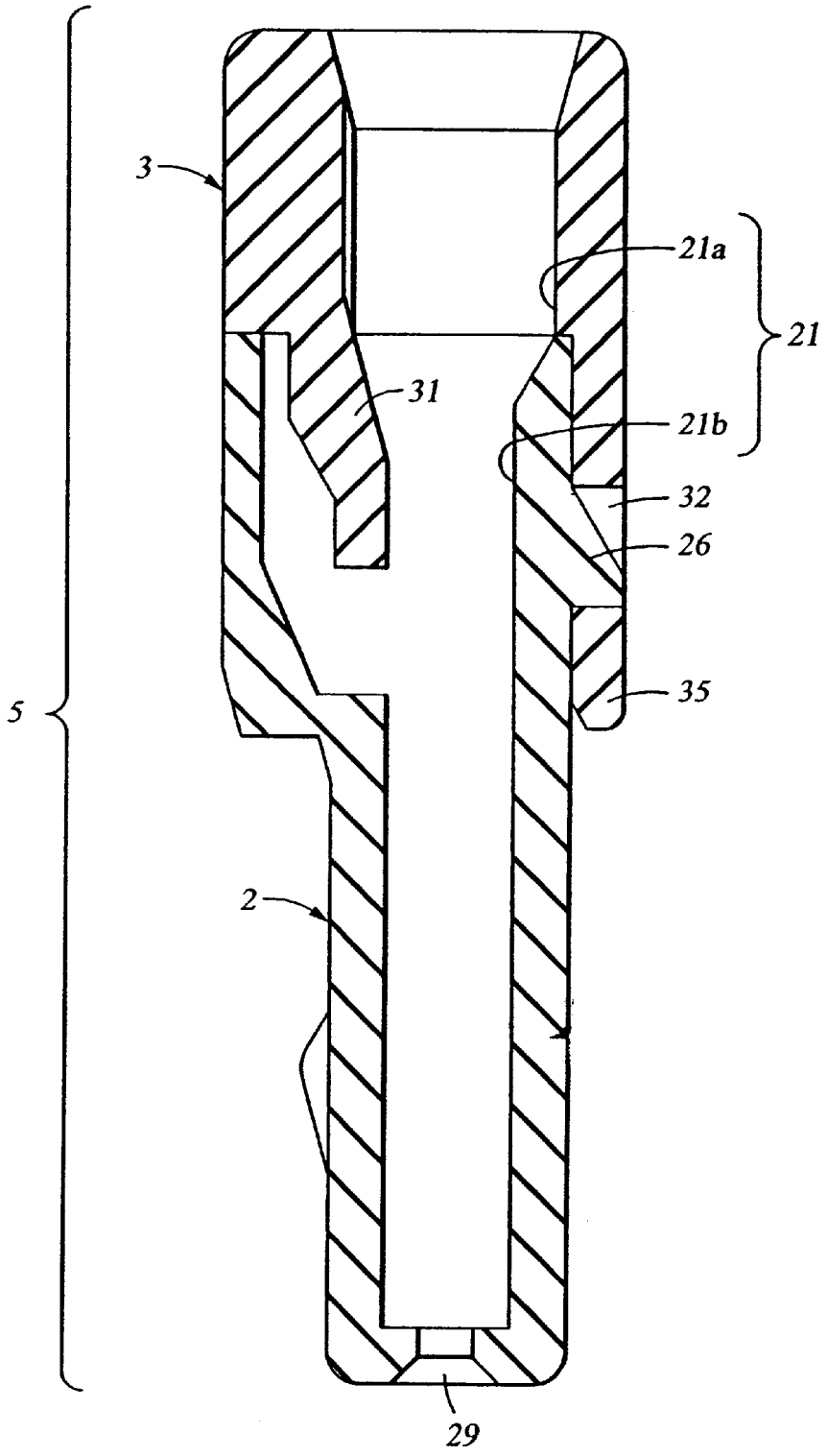
FIG. 6 is a sectional view, taken along line A—A of FIG. 1, showing the combined state of the first and second members included in the electrical connector shown in FIG. 1.

Each of the socket contacts 4 included in the electrical connector 1 of the embodiment is a cylindrical terminal attachment formed of metal such as copper and having a barrel 44 to which the lead line 42 is connected, as shown in FIGS. 1, 2 and 5. The socket contact 4 has, on one longitudinal surface thereof, a projection 41 bend toward the lead line 42. When the socket contact 4 is accommodated in the cavity 21, the projection 41 of the socket contact 4 is engaged with the projection 31 of the lance housing 3, as shown in FIG. 7. In other words, the projection 41 of the socket contact 4 and the projection 31 of the lance housing 3 are put in abutment with each other so that the socket contact 4 is prevented from moving in the direction of being taken out from the cavity. The socket connector 4 has, at a front end thereof, a female connector portion 45 in which a pin-contact pin (not shown) is inserted. The pin connector inserted in the female connector portion 45 is held by a retainer 47 in the female connector portion 45.

Next, the assembling procedures of the electrical connector 1 according to the embodiment will be described. First, the lance housing 3 and the socket housing 2 are assembled. Specifically, the projection 31 side of the lance housing 3 has access to the first region 22 of the socket housing 2, first. Then, the front ends of the projecting plates 35 formed in the lance housing 3 are brought into contact with the projections 26 provided in the socket housing 2. As the insertion of the lance housing 3 progresses, the projecting plates 35 are gradually resiliently deformed so as to be expanded outwards along inclined surfaces of the projections 26. When the projections 26 and the holes 32 correspond in position to each other, the are fitted to each other and the projection plates 35 are resiliently deformed to return back to the original position.

At the same time, the front ends of the projecting plates 33 are brought into contact with the projections 24 of the socket housing 2 and then are resiliently deformed so as to be expanded outwards along inclined surfaces of the projections 24. When front end portions of the projecting plates 33 climb over the projections 24, the projections 24 are fitted into the slots 33*a* respectively and also the convex portions 37 are fitted into the notches 28 respectively. As this manner, the housing 5 is completed.

In short, when the lance housing 3 and the socket housing 2, which have the configurations mentioned above, are assembled, the projections 26 in the socket housing 2 are fitted in the holes 32 in the lance housing 3 and, at the same time, the cutouts defined between the projecting plates 35 and the protrusions 27 of the socket housing 2 are fitted to each other. In addition, the convex portions 37 of the lance housing 3 are fitted in the notches 28 of the socket housing 2 and also the projections 24 provided in the socket housing 2 are fitted in the slots 33*a* in the lance housing 3. The above-mentioned fits cannot be released without forcibly expanding the projecting plates 35, 33 outwardly.

Thus, when the lance housing 3 and the socket housing 2 are assembled by fitting, the projections 31 of the lance housing 3, the projections 41 of the socket contacts 4 and their peripheries are placed in the interior of the cavities 21 and covered by the socket housing 2, as shown in FIG. 7. In other words, the projections 31 and the projections 41 are put in the state in which they cannot be operated or observed from outside, so that they are prevented from being exposed to the outside.

Then, the socket contacts 4 are inserted in the cavities 21 of the housing 5. When the each socket contact 4 is gradually inserted in the cavity 3, the projection 41 provided in the socket contact 4 comes into contact with the projection 31 of the lance housing 3. When the socket contact 4 is pressed further into the cavity 21, the projection 41 of the socket contact 4 shifts the projection 31 of the cavity outwardly of the cavity 21, while the socket contact 4 travels into the cavity 21. When the projection 41 passes past the front end of the projection 31, the projection 31 resiliently returns back to the original position and confronts the projection 41 so as to prevent the socket contact 4 from moving to a direction of being taken out from the cavity 21. As this manner, the assembly of the electrical connector 1 according to the embodiment is completed.

Thus, in the electrical connector 1 of the embodiment, the socket housing 2 and the lance housing 3 are detachably assembled without displacement by making two or more pairs of the related portions to be fitted to each other.

In the electrical connector 1 of the embodiment, since the lance housing 3 is molded separately from the socket housing 2 (in other words, the housing 5 has two block construction comprising the lance housing 3 and the socket housing 2), the lance housing 3 can be designed in a low profile, while ensuring the minimum thickness of the projection 31 required for the prevention against the take-out of the socket contact 4 and the space for the mold. In addition, since the housing 5 is designed as the two parts construction, the mold of the projection 31 of the lance housing 3 is facilitated, and as such can allow the pitch between adjacent accommodating cavities 21 to reduce to e.g. 1.5 mm or less or further to 1.25 mm or less. This enables the housing 5 itself to be reduced in side. Thus, the electrical connector 1 of this embodiment is suitable for use in small-size electronic equipment such as personal digital assistants.

Besides, since the projections 31 and the projections 41 of the socket contact 4, which are provided to prevent the socket contact 4 from falling off, are not exposed from the housing 5, the possibilities that accidental shorting of adjacent socket contacts may be caused by dusts and the like entering from the openings and that an operator may accidentally contact with the socket contact when a pin contact is plugged in or detached from the socket contact inserted in the cavity 21 of the housing 5 can be avoided.

In addition, in the electrical connector 1 of the embodiment, since neither the projections 31 nor the projections 41 are exposed from the housing 5, there is little possibility that the engagement between the socket contact 4 and the housing 5 may be accidentally released by exerting an external force on the projection 31 and/or the projection 41. Thus, the electrical connector 1 has the advantage of producing high reliability.

In the electrical connector 1 of the embodiment, the front portion 21*b* provided in the socket housing 2 has the first region having the thickness T1 on the lance housing 3 side and the second region having the thickness T2 on the opposite side, and the thickness T1 of the first region is made larger than the thickness T2 of the second region, so as to allow the projection 31 of the lance housing 3 to be easily accommodated in and covered by the first region 22 of the socket housing 2. In the state in which the projection 31 is covered by the first region 22 of the socket housing 2, a minimum clearance required for the projection 31 to be resiliently deformed outwards so as to accommodate the socket contact 4 in the cavity 21 without forming any obstacle is defined between the first region 22 of the socket housing 2 and the projection 31. The second region 25 of the socket housing 25 is formed to have a smaller thickness than the first region 22 of the same. Consequently, the housing 5 can be reduced in thickness to that extent, as compared with the case where the entire socket housing 2 is formed with same thickness as that of the first region 22.

Figure 11:
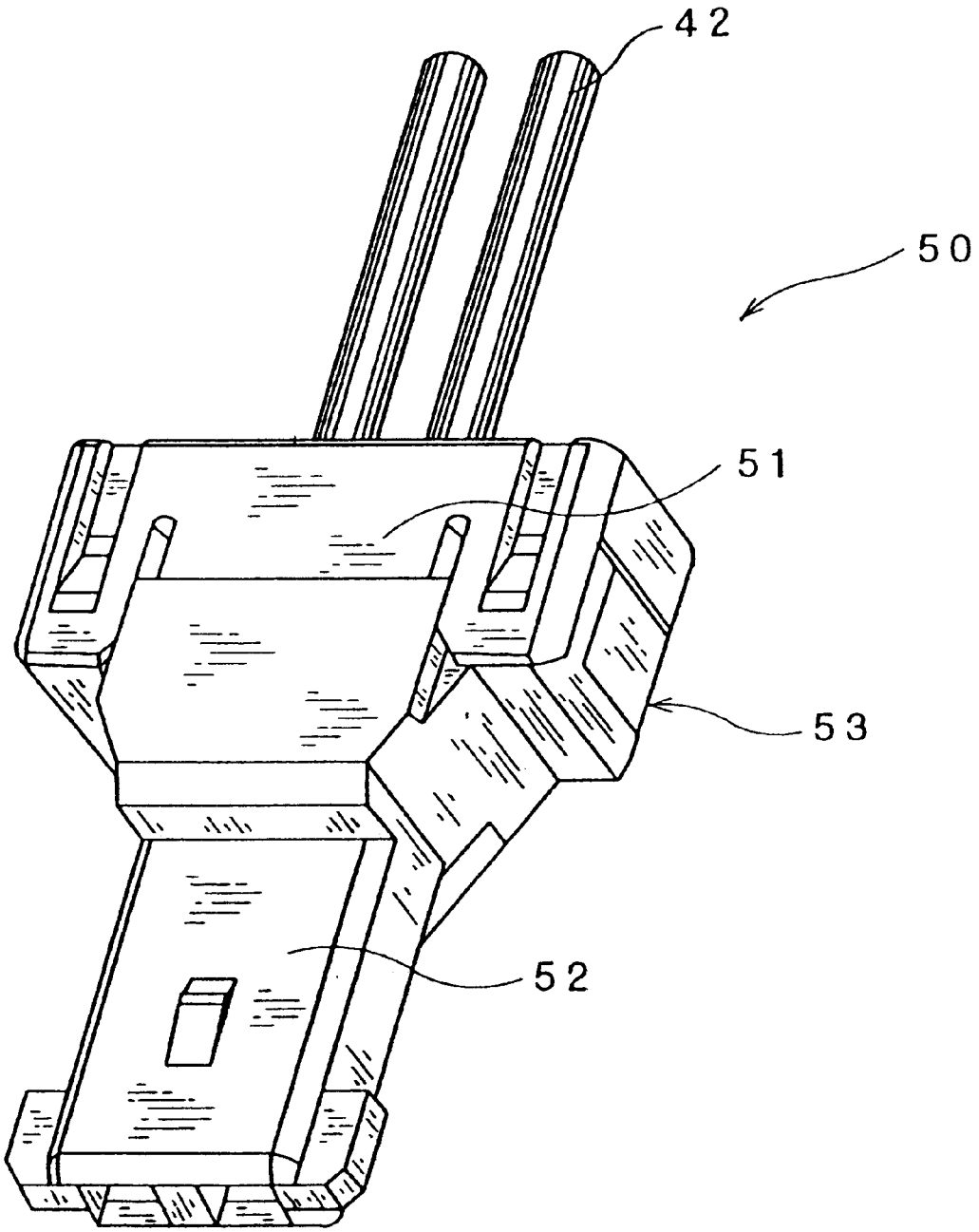
FIG. 11 is a perspective view of an electrical connector according to a second embodiment of the present invention.
Figure 12:
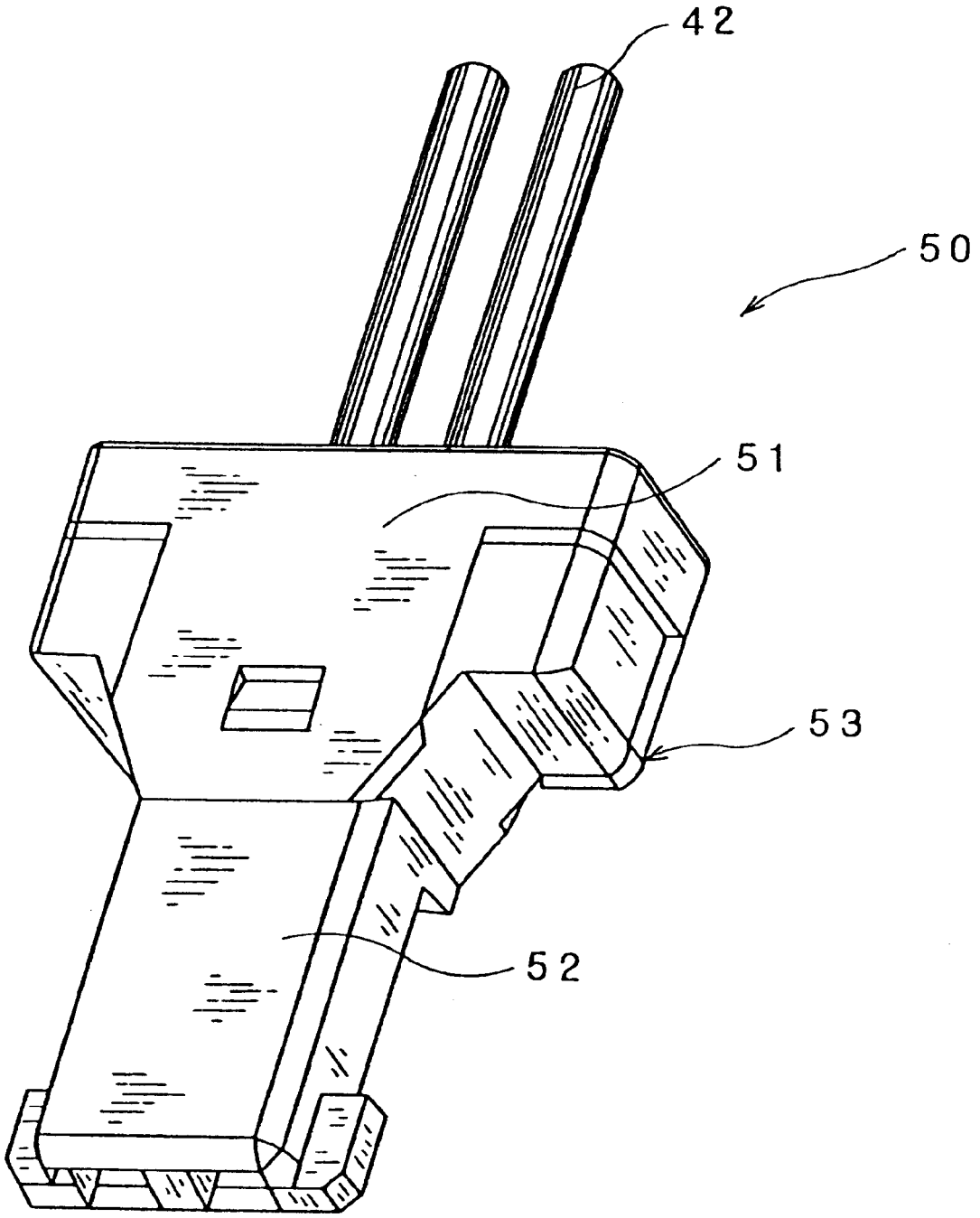
FIG. 12 is a perspective view of the electrical connector according to the second embodiment of the present invention as viewed from the opposite direction to that of FIG. 11.

Next, the electric contact according to the second embodiment of the present invention will be described. While the first embodiment above relates to the electrical connector having 14 terminal posts, the electrical connector of the second embodiment relates to an electrical connector having 2 terminal posts as shown in FIGS. 11 and 12. FIGS. 11 and 12 show a perspective view of the entirety of the electrical connector 50 having 2 terminal posts. Except the number of terminals of the electrical connector, the electrical connector of the second embodiment has substantially the same structure as the electrical connector of the first embodiment, so the related drawings such as sectional views are omitted. In the electrical connector with 2 terminal posts as well, the low-profile and small-size electrical connector 50 can be produced by foaming the housing 53 comprising two housings, i.e., the lance housing 51 and the socket housing 52, as shown in the drawings.

While there have been shown herein and described certain preferred embodiments of the invention, various design changes and modification may be made within the scope of the claimed invention without limiting to the illustrated embodiments. For example, the form of the cavity of the housing may be properly modified in correspondence with the form of the socket contact. The number of lances and the way of assembling the lance housing (the first member) and the socket housing (the second member) may be modified suitably.

What is claimed is:

1. An electrical connector comprising:

a contact having a contact lance;

a housing lance confronting said contact lance; and a housing having an accommodating cavity for accommodating said contact and the housing lance in such a manner as to prevent said contact from moving out of said cavity when said contact is in the state of being accommodated in said cavity, said housing consisting of:

a first member arranged at a side from which said contact is inserted in said cavity and provided with said housing lance; and a second member assembled to said first member so that said housing lance is covered by said second member, whereby the second member extends from a side of the first member opposite a side into which the contact is inserted and said contact and said second member protrude beyond said first member so that at least a portion of the cavity containing said contact is formed within the second member and protrudes beyond said first member.

2. The electrical connector according to claim 1, wherein said housing lance is shifted to a position where said contact is allowed to move in a direction of being accommodated in said cavity by being pressed by said first retaining portion when said contact is on the way to being accommodated in said cavity and is resiliently returned to a position where said contact confronts said contact lance with respect to a direction of being taken out from said cavity when said contact reaches a predetermined position in said cavity.

3. The electrical connector according to claim 1, wherein a portion of said cavity of said second member corresponding to a portion to cover said housing lance is larger in thickness than a remaining portion of said cavity of said second member.

4. The electrical connector according to claim 1, wherein a first outer surface formed on said first member and a second outer surface formed said second member including their boundary are formed approximately in plane on each side in their assembled positions.

5. The electrical connector according to claim 4, wherein each portion of said first member and said second member have a complementary configuration for their boundary.

6. The electrical connector according to claim 1, wherein said housing lance of said first member is apart from said second member in their assembled positions.

* * * * *